US006726139B2

(12) United States Patent
Persson

(10) Patent No.: US 6,726,139 B2
(45) Date of Patent: Apr. 27, 2004

(54) METHOD FOR FEEDING A THREAD WITHOUT TWISTS AND A THREAD FEEDING DEVICE

(75) Inventor: Sture Persson, Ulricehamn (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 10/203,702

(22) PCT Filed: Feb. 9, 2001

(86) PCT No.: PCT/EP01/01455

§ 371 (c)(1),
(2), (4) Date: Oct. 29, 2002

(87) PCT Pub. No.: WO01/58794

PCT Pub. Date: Aug. 16, 2001

(65) Prior Publication Data

US 2003/0122018 A1 Jul. 3, 2003

(30) Foreign Application Priority Data

Feb. 11, 2000 (DE) ..... 100 06 142

(51) Int. Cl.[7] ..... B65H 51/20

(52) U.S. Cl. ..... 242/365.3; 242/365.4; 139/452

(58) Field of Search ..... 242/365.3, 365.4; 139/452

(56) References Cited

U.S. PATENT DOCUMENTS 3,776,480 A * 12/1973 Lawson ..... 242/364.7
4,208,017 A * 6/1980 Ichikawa et al. ..... 242/365.4
4,462,434 A * 7/1984 Takegawa ..... 139/452
4,476,904 A * 10/1984 Ito et al. ..... 139/452
5,069,395 A 12/1991 Krumm
5,160,097 A * 11/1992 Josefsson et al. ..... 242/365.3
5,201,346 A * 4/1993 Cox ..... 139/450
5,211,347 A * 5/1993 Riva ..... 242/364.7
5,662,148 A * 9/1997 Jacobsson et al. ..... 139/450
6,082,654 A * 7/2000 Tholander et al. ..... 242/365.4
6,470,918 B1 * 10/2002 Ghiardo et al. ..... 139/452

FOREIGN PATENT DOCUMENTS

EP 0 396 902 11/1990
WO WO 00/74508 12/2000

* cited by examiner

*Primary Examiner*—John Q. Nguyen
(74) *Attorney, Agent, or Firm*—Flynn, Thiel, Boutell & Tanis, P.C.

(57) ABSTRACT

A method and apparatus for feeding a thread to a textile machine in a twist-free manner, which thread has a band-like character. The thread is taken twist-free from a stock and is stored on a stationary storage drum in a thread feeding apparatus. The thread feeding apparatus has a rotatable central shaft and a winding element which protrudes therefrom. During operation of the thread feeding apparatus, functional twists are produced in the thread only during the transition from the central shaft into the winding element. The twists are inhibited from being transported oppositely to the thread path direction and are regularly conveyed to the storage drum in almost perfect match with the rotations of the central shaft. At least one guide gap that is stationary in relation to the central shaft is provided along the thread path in the area of transition of the central shaft into the winding element.

21 Claims, 1 Drawing Sheet

METHOD FOR FEEDING A THREAD WITHOUT TWISTS AND A THREAD FEEDING DEVICE

FIELD OF THE INVENTION

The invention relates to a method and apparatus for feeding a thread without twists into a textile machine, such as a weaving machine.

BACKGROUND OF THE INVENTION

According to a method known from EP 03 96 902A (U.S. Pat. No. 5,069,395A), thread is supplied from a storage bobbin to the thread feeding device in twist-free condition by driving the storage bobbin with a rotation corresponding to the thread speed in the thread feeding device. In the interior of the thread feeding device, the thread passes the hollow central shaft and the winding element (which protrudes outwardly from the central shaft) before the thread is laid into adjacent windings on the storage drum. The thread is withdrawn by the textile machine from the thread windings and overhead of the storage drum, with an orbiting thread withdrawal point first inwardly and then further axially. Due to the function, a twist is generated in the thread with each rotation of the central shaft, i.e., a twist of 360° in the rotational direction of the central shaft. During withdrawal of a complete winding from the storage drum a twist is also formed, i.e. a twist of 360°, however, in the opposite direction of rotation. This means, theoretically, that each twist formed during winding-on should be removed during withdrawal such that the thread should run without twists into the textile machine. However, the transition from the central shaft into the winding element forms a mechanical obstacle in the thread running path. Since the thread is supported on the storage drum and the winding element is rotating in relation to the storage drum circumference, the winding element generates a pulling stress in the thread. Among other factors, the influence of the pulling stress in a band-shaped thread leads in practice to a phenomenon at the obstacle, which phenomenon disturbs the equilibrium between the generated twists and the twists removed during winding-off. Each formed twist is not conveyed downstream immediately, but one or several twists may accidentally be withheld upstream of the transition. The withheld twists may even form backwardly opposite to the thread running direction and first will pass the obstacle of the transition with a delay and/or in groups of several twists, respectively. In the event that a twist is missing in a winding on the storage drum, later during withdrawal of the same winding a twist in the opposite direction will be generated and then will be conveyed into the textile machine, or in the case that there are several twists in one and the same winding on the storage drum, then during withdrawal of the same winding only one twist is removed, while the remaining twists will be conveyed into the textile machine. Despite considerable efforts to supply the thread from the thread storage bobbin into the thread feeding device without any twists, fabric faults and function disturbances caused by twists cannot be avoided which twists originate from the operation of the thread feeding device only.

It is an object of the invention to provide a method of the kind as aforementioned as well as a thread feeding device for carrying out the method, by which fabric faults and function disturbances caused by twists originating from the operation of the thread feeding device can be avoided.

This object can be achieved by stationarily supporting the thread against twisting within the central shaft, so that twists generated during the functioning of the thread feeding device are prevented from forming within the central shaft, and so that one 360° twist is formed in each winding on the storage drum. In this regard, the thread is mechanically supported by a stationary thread guiding member or a band guiding gap.

When, according to the method of the present invention, during operation of the thread feeding device each generated twist is formed regularly and in correspondence with the rotation of the central shaft and immediately is conveyed into the first winding on the storage drum, and if a backward formation of one or of several twists opposite to the thread running direction from the location of transition from the central shaft into the winding element is hindered, the balance between twists generated during winding-on and twists removed during the withdrawal will be maintained stably. Thanks to the mechanical support of the running thread which prevents a thread rotation in the rotating central shaft, one twist is reliably formed in each winding on the storage drum, which twist then is removed during withdrawal of the same winding. The result is that the thread runs completely without twists into the textile machine, provided that the thread is supplied without twists to the thread feeding device.

In the thread feeding device, the incoming thread is supported stationarily by using the thread band cross-section to prevent thread rotation, at least upstream of the transition from the central shaft into the winding element, and the thread is mechanically guided such that the thread first can be twisted after exiting from the band guiding gap. The gap provides, due to its shape and due to its position at the transition, a check valve function and prevents a twist from starting to form earlier and tending to move backwards opposite to the thread running direction or prevents several twists from being formed and withheld. The stationary thread guiding gap assures that each twist formed during the rotation of the central shaft is formed at a predetermined location and is instantly conveyed through the winding element and into the winding on the storage drum. In the thread winding package on the storage drum each winding will contain only one twist. When withdrawing a winding overhead of the storage drum this twist is removed. In this case it is of importance that the thread is not only supported against pre-twisting during the operation of the thread feeding device, but also in a stop condition of the thread feeding device, because even then a twist may have a tendency to extend in the direction of the least resistance, i.e. opposite to the thread running direction and back into the central shaft, and to remain withheld at the transition with the following restarting of the operation of the thread feeding device.

Furthermore, it is expedient in terms of the method to support the thread during each revolution of the central shaft by a form-fit in order to control the formation of the twist and the proper transport of each twist. This avoids a twist remaining at the obstacle formed by the transition while the thread is running.

The band guiding gap is formed in the thread feeding device as a slot nozzle penetrating into the central shaft. The dimension of the slot nozzle in the direction of the slot exceeds the width of the bandshaped thread, while the gap width exceeds the thickness of the band-shaped thread, preferably only slightly, in order to assure a reliable safety against twisting of the thread and low thread passing resistance.

In a structurally simple way, the band guiding gap is provided at the free end of a carrier insert which penetrates from the thread inlet side into the central shaft, or which even may be formed by the free end of the carrier insert. The carrier insert is stationarily supported exteriorly of the central shaft at a housing wall of the thread feeding device, such that forces resulting from the guidance and deflection of the thread into the winding element are transmitted via the carrier insert to the outer side and are taken up by the housing wall. The carrier insert should not contact the rotating central shaft.

Forming the carrier insert as a rigid tube assures that the thread will not be caught or entangled along the thread running path to the band guiding gap. The band guiding gap may be formed as a tube end which is squeezed flat.

Alternatively, the slot nozzle forming the band guiding gap may be provided replaceably at the carrier insert. Depending on the kind of thread, i.e. the band width of the thread, the band thickness and the structure of the band (smooth, rough, or with fibres), a suitably sized slot nozzle will be used.

Alternatively, the slot nozzle may be replaced together with the carrier insert, e.g., if it is necessary to change from one yarn quality to another significantly different yarn quality.

The axial penetration depth of the band guiding gap into the central shaft should be adjustable in order to allow positioning of the band guiding gap in an optimum axial position in relation to the transition from the central shaft into the winding element.

In order to minimize the moving resistance of the thread in the band guiding gap, the band guiding gap should consist of a material which has good sliding properties and is wear resistant.

Expediently, the band guiding gap additionally has a guiding section of essentially constant cross-section. Advantageously, the band guiding gap is formed with a somewhat widened exit mouth.

In order to assure that one twist is formed with each revolution of the central shaft, a twist recess is provided at the transition. The twist recess rotates with the central shaft and acts upon the thread with a form-fit. The twist recess moderates the deflection of the thread and assists in a form-fit fashion during the revolution of the central shaft for properly forming the twists.

Expediently, the twist recess is located in the inner side of the knee between the hollow inner channel of the central shaft and a tube channel of the winding element. The thread exiting under deflection into the tube channel of the winding element is gripped by the recess and is taken along in the rotating direction to properly form the twists.

In order to assure a defined thread control, an eyelet may be provided in the transition, which eyelet is either completely closed or is only partially closed in the circumferential direction. The twist recess may be formed in the eyelet. The partial eyelet may extend essentially only over the circumferential width of the twist recess.

The twist recess may be a simple to manufacture V-shaped cut-out with a bottom, the bottom substantially bisecting the deflection angle between the central shaft and the winding element. This assures a mild deflection of the thread and moderates the influence of the obstacle constituted by the transition.

For easy mounting, the carrier insert may be fixed to the housing wall with the help-of a fastening part. The fastening part may have the shape of a cap, in order to guarantee a stable support. The cap may define a receiving cavity for a sensor which may be useful for other tasks in this portion of the thread feeding device.

BRIEF DESCRIPTION OF THE DRAWINGS

The invention will be explained with reference to the drawings, in which.

DETAILED DESCRIPTION

Figures 1, 2:
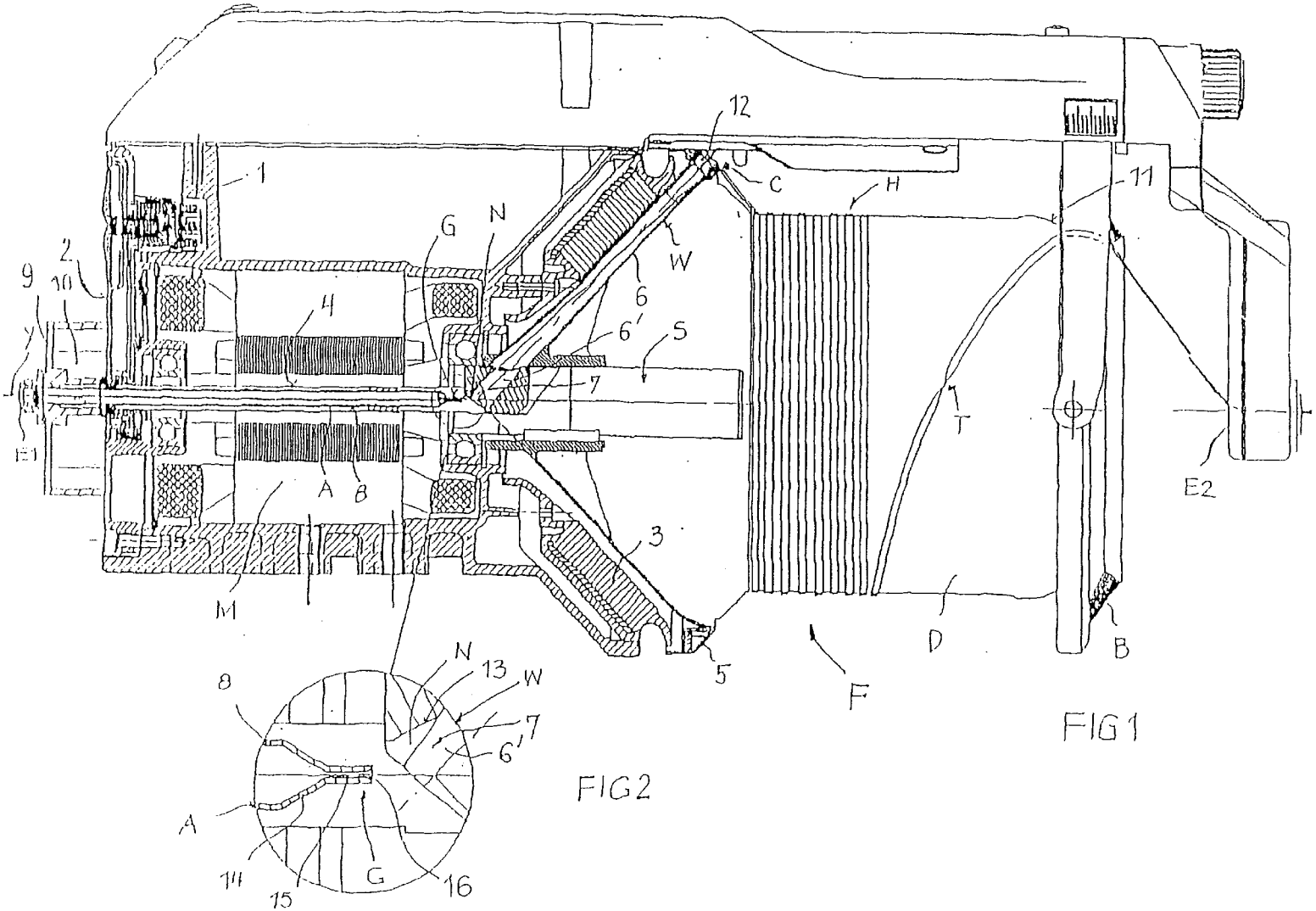
FIG. 1 shows a longitudinal section of a thread feeding device.
FIG. 2 shows a partial portion of the thread feeding device in an enlarged scale, as indicated in FIG. 1 by a circle.

A thread feeding device F in FIG. 1 contains in a housing 1 a drive motor M for driving a central shaft S. The central shaft has a section 4 leading to a housing wall 2. The section 4 is made hollow (hollow space 8). The central shaft S supports in a conventional fashion (not shown in detail) a coaxial storage drum D. The storage drum D is provided on the central shaft S and is hindered against co-rotation with shaft S by magnets 3 (i.e. the storage drum is stationary). A winding element W extends obliquely outwardly from the central shaft S. The winding element W has an interior tube channel 6' and a winding tube 6 prolonging the tube channel 6', and is integrated into a winding disk 5 which is provided for rotation between the housing 1 and the storage drum D. A yarn eyelet C is fixed in an exit 12 of the winding element W. A knee-shaped transition 7 is formed between the winding element W and the hollow space 8 of the central shaft S.

The hollow space of the central shaft S and the hollow interior of the winding element W commonly define a thread running path for a thread Y, which thread enters in FIG. 1 from the left side and is deflected outwardly at the transition 7, runs further through the winding element W, is deflected in the yarn eyelet C, and then is wound on the outer circumference of the storage drum D by forming subsequent and adjacent windings resulting in a winding package H. The winding package H forms an intermediate thread store for consumption by a textile machine. The thread Y is withdrawn from the winding package H overhead of the storage drum D, i.e., with an orbiting thread withdrawal point over the circumferentially continuous withdrawal rim 11 of the storage drum and through a thread brake B. The thread is then guided to a withdrawal eyelet E2 located coaxial with the storage drum D and is then fed to the textile machine (not shown), e.g. a weaving machine. The thread Y is originally supplied, without twists, from a thread store (not shown), e.g. a thread storage bobbin.

By the rotational movement of the central shaft S with its winding element W and the support of the thread Y on the storage drum D, the thread Y is pulled into the thread device F with a thread speed corresponding to the rotational speed. The package H is controlled by sensors (not shown) to maintain a certain size on the storage drum D. The textile machine consumes the thread Y upon demand, in case of a weaving machine intermittently, whereby the drive motor M is driven faster or slower or is stopped, in order to maintain the winding package H with the predetermined size. In the event that there is no consumption, the drive motor M is stopped.

The rotation of the central shaft S forms one 360°-twist with each revolution in the thread Y where it is deflected at the transition 7. The twist is transported with the running thread into the first winding in the winding package H. A 360°-twist T is indicated in the last winding of the winding package H, just as the winding is being withdrawn. During withdrawal of the thread Y overhead of the storage drum D, the thread withdrawal point orbits along the withdrawal rim 11 in the direction of rotation of the central shaft S such that the previously formed 360°-twist is again removed from the thread winding with each withdrawn full winding.

The design and function of the thread feeding device F as described above is conventional. The thread feeding device as shown and according to the invention is intended to process threads Y of band-like character. Such threads, e.g., may be polypropylene-monofilaments, so-called lurex threads, bands or foil bands, the common characteristic of which is an at least almost rectangular cross-section with a band width exceeding the band thickness. The cross-section does not need to correspond to a rectangle but could also be oval, bi-concave or bi-convex. Such threads frequently have to be processed twist-free, because twists introduced into the final product either produce visible and detectable fabric faults or lead to thread breakages or other disturbances, or, in case of particularly strong threads of band-like character e.g. carbon threads, to function disturbances when the twisted thread passes any detecting devices or tensioning devices provided along the thread running path.

In order to process the thread Y without twists upstream of the thread feeding device F, measures are provided to introduce the thread from the thread storage bobbin without twists into the thread feeding device F. For example, in the case of axial withdrawal of thread from a thread bobbin, the thread bobbin is rotated in accordance with the thread speed in the thread feeding device such that the withdrawal point of the thread from the thread bobbin remains essentially stationary in space. Another known possibility is to tangentially wind-off the thread from a cylindrical thread bobbin and to rotate the thread bobbin in the pull-off direction corresponding with the thread speed in the thread feeding device.

Due to the function and the design of the thread feeding device F, and as explained earlier, one 360°-twist is formed in each winding with each full revolution of the central shaft at the transition 7. This twist will be removed from the same winding during the overhead withdrawal. For that reason, the thread feeding device F theoretically could not have any influence on the twist-free processing of twist-free supplied thread. Practice, however, shows that not each winding in the winding package H will contain one 360°-twist, but sometimes one or even several twists are held back at the transition 7, meaning that some windings on the storage drum D do not contain a twist or that some thread windings on the storage drum contain several of the earlier held back twists which have been transported abruptly into this winding. This causes an imbalance. The imbalance results in the fact that during overhead withdrawal either a counter twist is formed and introduced into the textile machine or that of the several twists contained in the one winding only one is removed and the remaining twists will run into the textile machine.

In order to avoid the above-mentioned imbalance, the thread feeding device F according to the invention is provided with additional equipment. Directly at the transition 7 from the hollow space 4 of the central shaft S into the winding element W, a band guiding gap G is positioned stationarily (FIG. 2) which is formed like a slot nozzle. The gap width of the slot nozzle is slightly larger than the band thickness. The slot width is larger than the band width of the thread Y of band-like character. The band guiding gap G is arranged on a carrier insert A, e.g. at a tube 8. The carrier insert A is introduced without contact into the hollow section 4 of the central shaft S from the thread entrance end and is positioned by a fastening element 9 which, e.g., can be fixed at the housing wall 2. The fastening element 9 contains a thread eyelet El at the entrance side and defines a cavity 10 in which e.g. a sensor can be located.

According to FIG. 2, the band guiding gap G formed as a slot nozzle is provided with a constant cross-section guiding section 15 extending in the thread running direction or parallel to the axis of the central shaft S, respectively, and is provided additionally with an e.g. rounded widened outlet mouth 16. The front end of the carrier insert A (e.g. formed as tube 8) is conical with a decreasing diameter in the thread running direction or is squeezed flat (at 14). In this way the band guiding gap G is defined by the free end of the tube 8. Alternatively, the carrier insert A could be formed as a rod or a double rod positioning a slot nozzle which is replaceably fixed thereto. The penetration depth of the band guiding gap G or the carrier insert A into the central shaft S may be adjustable. Furthermore, it is possible to expand the band guiding gap G such that it extends over a larger axial part of the central shaft S as shown or such that it extends over the entire penetration depth.

A twist recess N, e.g. with the form of a V-cut-out is formed at the transition 7. The bottom 13 of the cut-out bisects the deflection angle between the axis of the central shaft S and the winding element W. The twist recess N is provided at the inner side of the knee-like transition 7. The band guiding gap G is positioned such that, e.g. in the axis of the central shaft S, the exiting thread reliably enters the twist recess N and is taken along in the rotation direction with the twist recess N.

The stationarily positioned band guiding gap G acts like a check valve and not only prevents jamming of a twist upstream of transition 7, but also takes care that no twists can form back into the hollow section 4 of the central shaft S opposite to the thread running direction. To the contrary, one twist is reliably formed when exiting the gap G and is transported with the running thread during the twist formation and is present in the first winding on the storage drum D, such that each winding in the winding package H will contain one 360°-twist T which will be reliably removed again during the overhead withdrawal of the same winding. The twist recess N acts with a form-fit such that it helps to properly form and to immediately transport away the twist just generated and such that it moderates the mechanical influence of the obstacle of the transition 7 for the transport of the twist. However, the twist recess N is not necessary for all cases.

In other words, the thread Y is supported directly upstream of the transition 7 against rotation or twisting and is guided in this region. By this guiding effect a formation of twists opposite to the running direction is suppressed. Each twist while under formation is immediately transported further through the winding element W. The twist recess N assists in the correct formation of each twist and also assists in the smooth transport of the just formed twist. The thread introduced without twists into the thread feeding device F leaves the thread feeding device reliably without twists.

Expediently, the band guiding gap G is formed from a material having good sliding properties and high wear resistance. As an alternative, the band guiding gap G at least could have a lining made of such material. A central eyelet may be positioned at the transition 7 which central eyelet is made from material which has good sliding properties and high wear resistance. The central eyelet either is continuous and closed in the circumferential direction or extends at least along the circumferential extent of the twist recess N.

The carrier insert A can be removed together with the band guiding gap G in the event that it is not needed. Alternatively, the carrier insert A with its band guiding gap G can be a retrofit part allowing one to transform conventional thread feeding devices into twist-free thread feeding devices.

The storage drum D shown only schematically may be a rod cage with rods which are moveable in relation to each other in order to produce a thread separation (i.e. axial intermediate distances between adjacent windings in the winding package H).

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A method of feeding thread of a band-like character without twists into a textile machine, said method comprising:

releasing the thread from a thread store without twists;

supplying the thread without twists into a thread feeding device through a rotating central shaft of the thread feeding device;

feeding the thread from the central shaft into a winding element which protrudes outwardly from the central shaft;

winding the thread onto a stationary storage drum with the winding element and forming a plurality of thread windings on the storage drum;

stationarily supporting the thread against twisting within the central shaft to prevent twists generated during functioning of the thread feeding device from forming within the central shaft and to permit the formation of a single 360° twist in each thread winding on the storage drum; and feeding the thread without twists from a position overhead of a withdrawal end of the storage drum to the textile machine.

2. The method of claim 1, including removing the single twist from each thread winding during overhead withdrawal of each of the thread windings from the storage drum.

3. The method of claim 1, including supporting the single twist during formation thereof and during transport thereof onto the storage drum in a form-fit manner.

4. The method of claim 1, wherein said step of stationarily supporting includes providing a thread guiding structure at a transition area defined along the thread path where the thread exits the central shaft and enters the winding element.

5. The method of claim 4, including mechanically guiding the thread at the transition area with the thread guiding structure to prevent the formation of twists within the central shaft, and permitting twisting of the thread only after the thread exits the thread guiding structure.

6. The method of claim 5, including providing the guiding structure within the central shaft so that the thread guiding structure is stationary relative to the central shaft, the thread guiding structure defining an elongated slot therein having a longitudinal dimension which is slightly larger than a width of the thread and a transverse dimension which is slightly larger than a thickness of the thread.

7. A thread feeding device for feeding thread of a band-like character without twists into a textile machine, said thread feeding device comprising:

a stationary storage drum for storing thereon a plurality of adjacent thread windings which together defining a winding package;

a rotatably driven central shaft defining a hollow interior and mounting thereon a winding element which defines a hollow interior and protrudes outwardly from said central shaft;

a thread running path extending axially through said interior of said central shaft, through said interior of said winding element, to said storage drum and overhead of a withdrawal end of said storage drum; and a thread guiding member defining a gap therein, said thread guiding member being disposed stationarily relative to said central shaft and being disposed along the thread running path in a transitional region where the thread exits said central shaft and enters said winding element.

8. The thread feeding device of claim 7 wherein said thread guiding member comprises a nozzle which penetrates said central shaft and defines said gap therein through which the thread travels, said gap being slot-shaped and having a longitudinal width dimension which slightly exceeds a width of the thread and a transverse dimension which slightly exceeds a thickness of the thread.

9. The thread feeding device of claim 8 wherein said nozzle is axially adjustably mounted within said central shaft.

10. The thread feeding device of claim 7 further including a carrier projecting into said central shaft from an upstream end thereof adjacent a housing of said device, said carrier having a first end supported externally on said housing such that said carrier is stationary relative to said central shaft and does not contact said shaft, and said carrier having a second free end at which said thread guiding member is disposed.

11. The thread feeding device of claim 10, further including a cap-shaped fastening element fixed to an exterior of said housing, said first end of said carrier being mounted within said fastening element.

12. The thread feeding device of claim 10 wherein said thread guiding member is formed integrally with said carrier or as a separate component from said carrier.

13. The thread feeding device of claim 10 wherein said thread guiding member is a separate component from said carrier to permit replacement thereof.

14. The thread feeding device of claim 10 wherein said carrier is configured to permit replacement of said carrier and said thread guiding member in said device.

15. The thread feeding device of claim 10 wherein said carrier is defined by a tube having a free end which defines said second free end at which said thread guiding member is disposed, said second free end having a conical configuration which tapers inwardly in the direction of the thread running path and adjoins said thread guiding member, said thread guiding member having a flattened, tubular shape such that said gap is elongated and slot-shaped to correspond closely to the transverse cross-sectional profile of the thread.

16. The thread feeding device of claim 10 wherein said carrier is defined by a tube having a free end which forms said second free end at which said thread guiding member is disposed, said thread guiding member having a flat, tubular shape such that said gap is elongated and slot-shaped to correspond closely to the transverse cross-sectional profile of the thread, said gap of said thread guiding member comprising a first part having a substantially constant cross-sectional configuration in the direction of the thread running path and a second part disposed downstream of said first part, said second part defining a mouth through which the thread exits said thread guiding member, said mouth having a cross-sectional configuration which is greater than said cross-sectional configuration of said first part, said transitional region being knee-shaped to deflect the thread outwardly from said interior of said central shaft and into said interior of said winding element, said winding element rotating with said central shaft, and said transitional region defining a recess therein configured to form-fittingly receive a twist in the thread after same exits said thread guiding member.

17. The thread feeding device of claim 7 wherein said thread guiding member is constructed of a wear-resistant and low-friction material.

18. The thread feeding device of claim 7 wherein said gap of said thread guiding member comprises a first portion having a substantially constant cross-sectional configuration in the direction of the thread running path, said gap comprising a second portion downstream of said first portion, said second portion defining a mouth through which the thread exits said thread guiding member, said mouth having a cross-sectional configuration which is greater than said cross-sectional configuration of said first portion.

19. The thread feeding device of claim 7 wherein said transitional region defines therein a recess which is configured to form-fittingly receive a twist in the thread, said twist being formed only after the thread exits said thread guiding member.

20. The thread feeding device of claim 19 wherein said transitional region is knee-shaped to deflect the thread outwardly from said interior of said central shaft and into said interior of said winding element which rotates with said central shaft, and said recess is defined adjacent an inner end of said knee-shaped transitional region and rotates along with said central shaft and said winding element.

21. The thread feeding device of claim 20 wherein said recess has a V-shape and a bottom portion of said V-shape substantially bisects a deflection angle of the thread between said central shaft and said winding element.

* * * * *